United States Patent [19]

Engdahl, Jr.

[11] 4,253,564

[45] Mar. 3, 1981

[54] BOTTLE CARRIER

[75] Inventor: Arnold B. Engdahl, Jr., Irvin, Calif.

[73] Assignee: Federal Paper Board Co., Inc., Montvale, N.J.

[21] Appl. No.: 40,727

[22] Filed: May 21, 1979

[51] Int. Cl.[3] ..... B65D 85/40

[52] U.S. Cl. ..... 206/183; 206/187; 206/193; 206/198; 229/28 BC

[58] Field of Search ..... 206/170, 189, 192, 198, 206/181, 183–185, 187, 188, 191, 193; 229/28 BC

[56] References Cited

U.S. PATENT DOCUMENTS

| | | | |
|---|---|---|---|
| 3,709,400 | 1/1973 | Arneson | 206/187 |
| 4,146,129 | 3/1979 | Wood | 229/28 BC |
| 4,153,158 | 5/1979 | Graser et al. | 206/188 |
| 4,171,046 | 10/1979 | Bonczyk | 206/193 |

*Primary Examiner*—Joseph Man-Fu Moy
*Attorney, Agent, or Firm*—Guy A. Greenawalt

[57] ABSTRACT

An upwardly opening tray-like carrier carton is disclosed for packaging a plurality of articles having the general form of beverage bottles, which carrier is fabricated from a single blank of foldable sheet material and is cut and scored so as to divide it into integrally connected panels which are adapted to be folded together so as to form, when set-up, a partitioned carton structure comprising a double row of upwardly opening bottle receiving cells disposed on opposite sides of a central bottle separating partition and handle forming panel assembly and being characterized by an upstanding partition wall extending between the rows of cells on each side of the partition and handle forming assembly which is hinged at its opposite ends to pairs of foldable end wall panels so as to enable the cells on each side of said central partition and handle forming panel assembly to be collapsed, when empty, and to be folded into flattened relation against said partition and handle forming assembly. In another form of the carrier disclosed the bottle separating cells are formed with a double thickness of the blank material separating the bottles so as to comply with railway shipping requirements.

10 Claims, 22 Drawing Figures

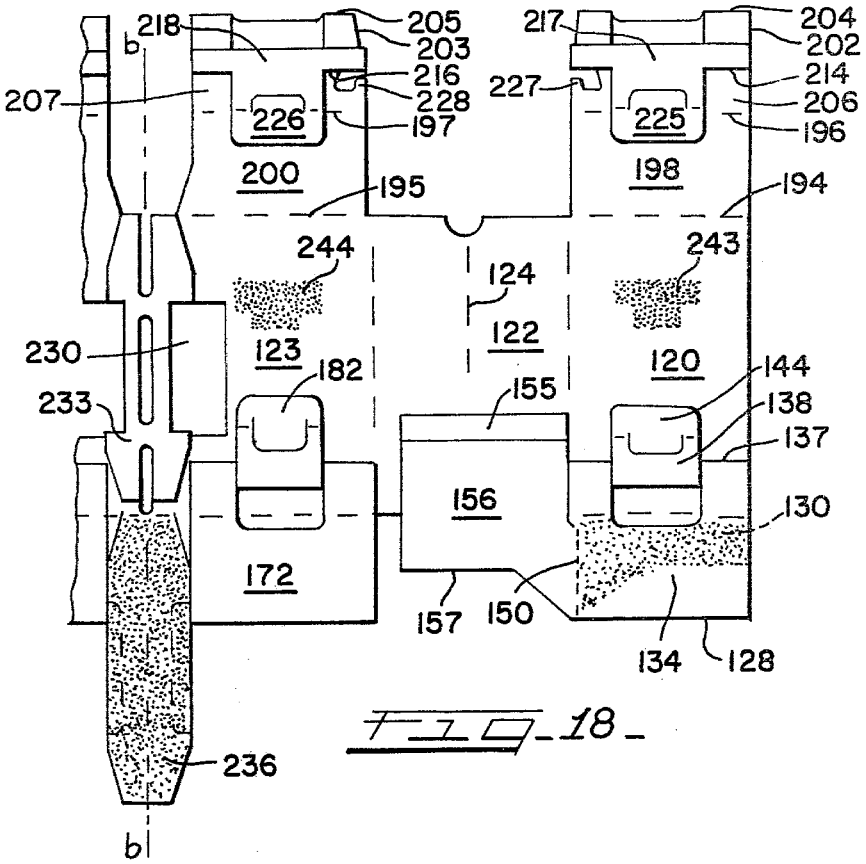
FIG. 18
FIG. 19
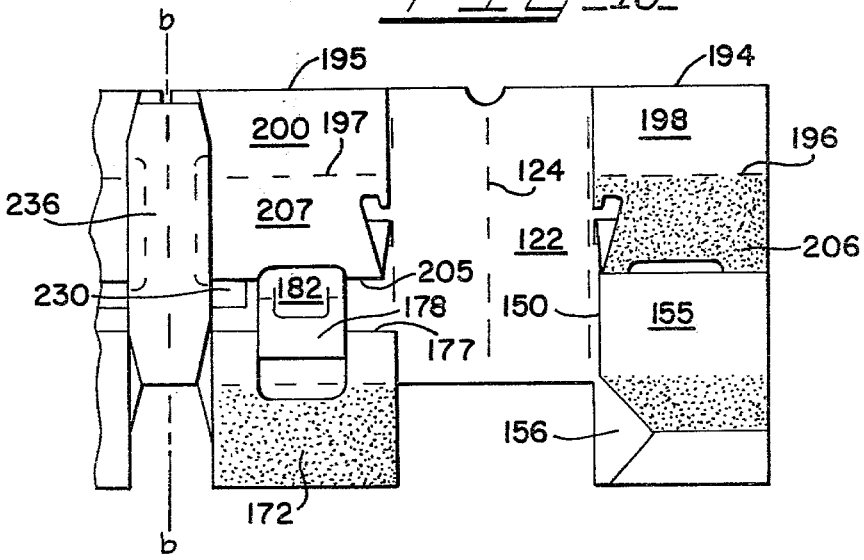

BOTTLE CARRIER

BACKGROUND OF THE INVENTION

This invention relates to cellular basket type carrier packaging for beverage bottles or similar bottled products and is more particularly concerned with improvements in basket carriers which are formed from paperboard blanks, or equivalent foldable sheet material, and which provide a double row of bottle accommodating cells arranged on opposite sides of a central longitudinal partition and handle structure.

In the marketing of bottled beverages one form of container which has long been employed for convenience in handling multiple unit packages, generally, of six, eight, or twelve bottles which are of the returnable type, has been a collapsible carton formed from a foldable paperboard blank which is cut, scored and glued up so that it may be opened up in the form of a basket with a plurality of upwardly opening cells in which the bottles are adapted to be received. Such containers are expected to have a limited life due to the relatively rough handling generally encountered. They are fabricated from a relatively light weight material so as to effect maximum economy of materials and to compete with other package arrangements, some of which are in the form of one-trip disposable units. The most commonly employed bottle carrier of the basket type is characterized by a single row of the bottles disposed one each side of a longitudinal center partition structure which includes a handle formation, the number of bottles in a row being generally three or four, with the handle formation being located so that when the basket is full, the load will be balanced for comfortable carrying. While there has been some effort to provide a carrier of this type which will accommodate a number of bottles greater than the six or eight commonly provided for, the increase in length of the carrier required for accommodating the larger bottle assembly has not proven satisfactory for many reasons. Consequently, the need to meet a demand for a satisfactory package for a larger group than the conventional six or eight bottle assembly has led to efforts to design a cellular carrier which will accommodate two rows of bottles on each side of the handle area so as to accommodate a larger group of bottles, twelve in particular, while maintaining a manageable overall length so that the greater weight is better distributed and the package may be carried in a comfortable manner.

It is a general object of the invention to provide an improved multicellular package unit for bottled beverages or similar products which may be fabricated from foldable sheet material and which is designed to accommodate two rows of bottles in paired arrangement on opposite sides of a center partition and handle structure which extends vertically between the two rows and separates the bottles in the two adjoining inside rows.

It is a more specific object of the invention to provide a multi-cellular basket type carrier for products having the shape of beverage bottles which is adapted to be formed in collapsed condition from a cut and scored blank of relatively light gauge paperboard stock and which, in the opened up condition, will provide two rows of bottle receiving cells on opposite sides of a center partition structure which partition structure incorporates a handle forming section enabling the weight to be distributed, when the carrier is filled with the bottles, so as to permit carrying the resultant package in a comfortable manner.

A further object of the invention is to provide a bottle carrier carton which is adapted to be formed by cutting and scoring a single blank of paperboard, or similar foldable sheet material, so as to divide the same into a plurality of panels which may be folded and connected in collapsed condition and thereafter opened up into the form of a basket with a double row of upwardly opening cells forming bottle receiving pockets on opposite sides of a central upstanding bottle separating partition structure having upper portions which are adapted to be grasped for carrying the carton when loaded with the bottles.

A still further object of the invention is to provide an improved bottle package comprising a traylike carton, when set up, in which a double row of bottles may be disposed in upwardly opening pockets provided on opposite sides of an upstanding central partition structure, which partition structure includes a handle forming portion for carrying the package and wherein the cellular carton structure may be formed from a single cut and scored blank of paperboard, or other suitable sheet material, which is divided into a plurality of panels adapted to be folded and secured so as to form, when set up, bottle receiving pockets having a double thickness of material for separating confronting portions of the bottles so as to comply with railroad shipping requirements for separation of the bottles.

To this end the invention which is claimed herein comprises an elongate carton forming blank which is divided into a series of wall forming panels, and a carton formed therefrom, for packaging bottled products, which carton is in the form of a tray having a double row of upwardly opening bottle receiving cells disposed on opposite sides of a central partition and bottle separating wall structure, which partition structure is derived from panels formed in the central portion of the elongate blank and has an upper portion which is arranged for grasping by the hand so as to enable the package to be conveniently carried when it is loaded with bottles, the central partition and bottle separating structure being hinged at its opposite ends to the vertical edges of pairs of end wall forming panels, the other one of each pair thereof having an outboard hinged connection with a sidewall forming panel, and the cells in each of the double row thereof being defined in part by an upstanding partition wall which extends between the rows and which is hinged at its opposite ends to foldable end wall panels on a vertical hinge line which foldably connects the end wall panels and enables the cells on each side of the central partition and bottle separating wall structure to be collapsed, when empty, and to be folded into flattened relation against said central partition and bottle separating wall structure.

The foregoing objects and other objects and advantages of the invention will become more apparent when reference is made to the accompanying detailed description of the preferred embodiments of the invention which are set forth therein, and shown in the accompanying drawings wherein like reference numerals indicate corresponding parts throughout.

In the drawings:

BRIEF DESCRIPTION OF THE DRAWINGS

FIG. 18 is a plan view of a portion of the blank of FIG. 17 showing the first folding steps in forming the carton of FIG. 12;

FIG. 19 is a plan view of a portion of the blank of FIG. 17 showing further folding steps;

DESCRIPTION OF THE PREFERRED EMBODIMENTS OF THE INVENTION

Referring first to FIGS. 1 to 11 of the drawings, there is illustrated a carrier carton 10 (FIG. 1) which embodies the principle features of the invention and which is adapted to be filled with twelve beverage bottles, arranged six in double row relation on each side of a central partition and handle structure 11 so as to provide a consumer package unit of a larger number of bottles than the six and eight basket style packages commonly used in the marketing of bottled beverage products. The carton 10 is fabricated from a single, one piece blank 12 (FIG. 6) of flexible paperboard sheet material which is of generally rectangular outline and which may be relatively thin, for example, having a thickness of 0.020 inch., commonly referred to as 20 point paperboard stock. The blank 12 is cut and scored so as to divide it into wall and partition forming panels which are thereafter folded and secured together to form the upwardly opening tray-like cellular basket carrier of FIG. 1.

Figure 6:
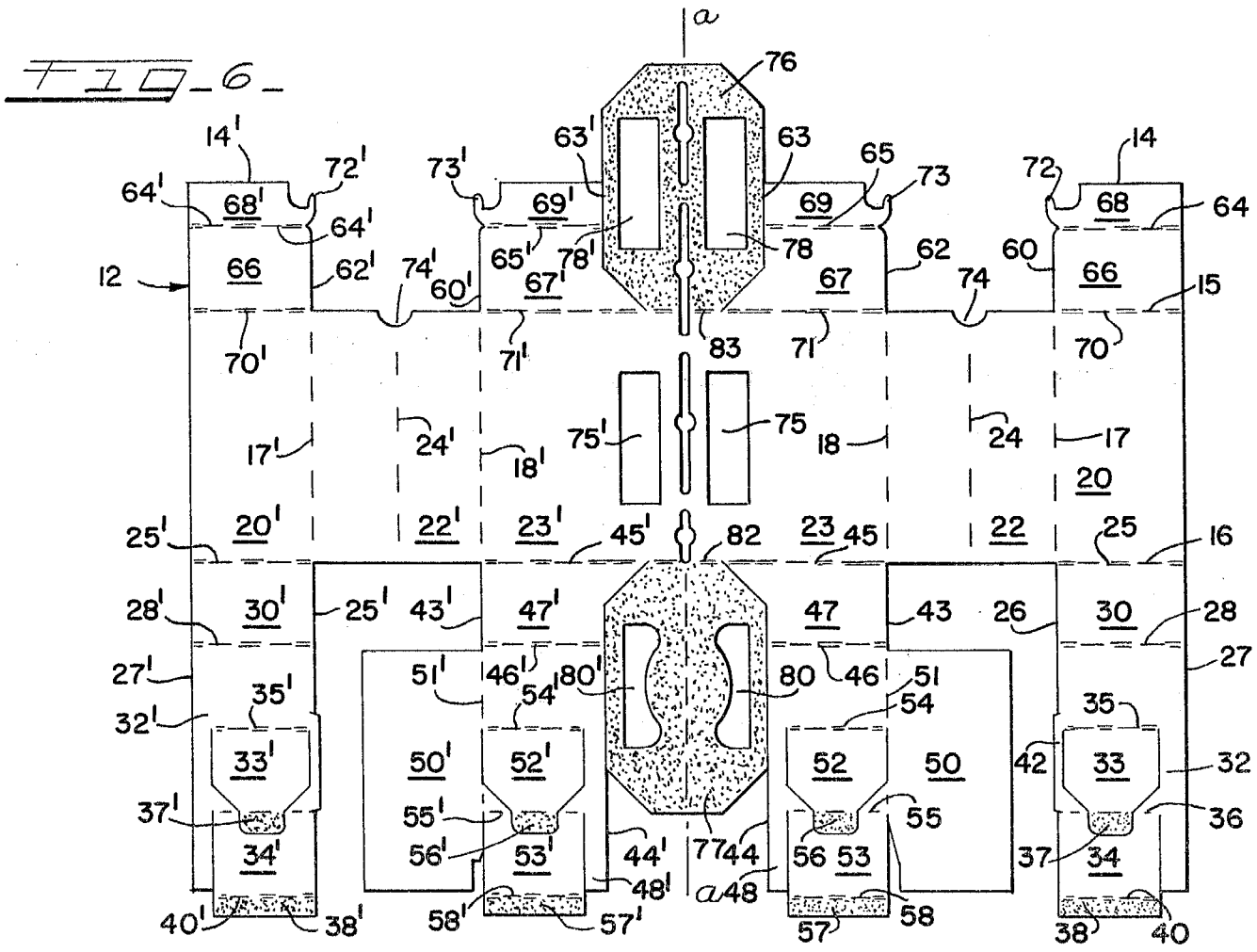
FIG. 6 is a plan view of a paperboard blank which is cut and scored preparatory to forming the carton of FIG. 1.

The cut and scored blank 12 is symmetrical about a transverse center line a—a and where an element found on one side of the transverse center line a—a has a counterpart on the other side thereof it will be designated by the same numeral primed. Since the blank section or half 14′ on one side of the center line a—a is a mirror image of the blank section 14 on the other side of line a—a the views of the drawing in FIG. 2, 3, 7 and 8 have the one side portion 14′ broken away so as to effect some economy in illustrating and describing the carrier structure, it being understood that the blank section 14′ which is broken away is cut and scored as shown in FIG. 6, to provide the panels required for duplicating the cell arrangement on that side of the line a—a, the latter coinciding with the fold line between the two sections 14 and 14′.

The blank sections 14 and 14′ are of equal size in the longitudinal direction of the blank and both sections are divided by cutting and scoring on transversely spaced parallel lines 15, 16, which extend longitudinally of the blank, and which define between them blank sections which are subdivided by longitudinally spaced parallel transverse score lines 17, 18 and 17′, 18′ to provide a sidewall panel 20, a bottom wall panel 22 and a partition and handle forming panel 23 on the one side of the transverse center line a—a and corresponding wall and partition forming panels 20′, 22′ and 23′ on the opposite side of the line a—a. The bottom wall forming panels 22, 22′ are each further subdivided by parallel, transverse score lines 24 and 24′ into two equal half panels to enable folding of the same into collapsed relation, as hereinafter described. Side portions or sections of the blank 12 are cut and scored to provide end wall and cell forming partition panels. At the one side of the blank the material in the section 14 is cut so that a partition panel forming portion extends laterally of the blank from the hinge score line portion 25 which coincides with the longitudinal line 16. A cutting line 26 forming an extension of the transverse score line 17 defines between it and the end edge 27 of the blank, a longitudinal and transverse partition forming panel which is subdivided by a score line 28 to provide an end wall forming panel 30 and a partition forming panel 32. The Panel 32, which is adapted to form a portion of the bottle separating partition between the two rows of cells on that side of the center partition and handle structure in the set-up carrier, has cut therein cross partition forming panels 33 and 34. The end wall forming panel 30 has a dimension transversely of the blank 12 which corresponds to one half the distance between the transverse score lines 17 and 18. The cross partition forming panels 33 and 34 which are cut in the panel 32 are adapted to hinge on the parallel, spaced score lines 35 and 36. The score lines 35 and 36 are spaced apart and the innermost one 35 is spaced from the score line 28 an equal distance according to the size of the bottles which the cells are designed to accommodate. These cross partition panels 33, 34 are provided with glue tabs 37, 38 which are arranged to hinge on the score line 36 and 40, respectively. The effective dimension transversely of the blank and from the score line 28 to the outboard end of the panel 32 is slightly less than the dimension of the panel 22 in the same direction. The panel 32 may have a slight bulge portion 42 provided by offsetting a portion of cutting line 36 in the center area between the ends thereof. On the same side of the blank 12, the material is cut and scored on the longitudinally spaced transverse lines 43 and 44 to define between the same a partition panel forming section extending laterally of a hinge score line 45 coinciding with line 16. The partly cut, partly scored line 43 constitutes an extension of transverse line 18 with the distance between lines 26 and the inner portion of line 43 corresponding to the distance between lines 17 and 18. This blank section which extends laterally of the hinge score line 45 is subdivided by a score line 46 which is aligned with the score line 28 so as to provide an end wall forming panel 47 and a partition forming panel 48, the latter having a portion 50 in the area which extends laterally of the panel 22. The panel 48 is divided by the transverse score line 51 which is aligned with score line 18 and the inboard portion of cutting line 43. The panel 50 is rectangular with approximately the same dimensions as the panels 32 and 48, and folds on the score line 51 into engagement with the panel 48 in forming the carton 10 so as to lie between panels 32 and 48 in final position. The panel 48 has cut therein cross partition forming panels 52 and 53 which are adapted to hinge on the score lines 54, 55, the latter being spaced from each other and from the score line 45 the same distance. The panels 52 and 53 correspond to the panels 33 and 34 with each having a glue tab 56, 57 arranged to hinge on the score lines 55 and 58. The apertures resulting from folding the panels 52 and 53 out of the plane of panel 48 are closed by the reinforcing panel 50.

At the opposite side of the blank, the material is cut on the transverse lines 60, 62, and 63 in the same fashion as on the lines 26, 43, and 44, and scored on longitudinally extending lines 64 and 65 to provide a pair of end wall forming panels 66 and 67 with narrow partition connecting panels 68 and 69 outboard of the score lines 64 and 65. The end wall forming panels 66, 67 correspond, dimensionwise, to the end wall forming panels 30 and 47 and are hingedly connected to the panels 20 and 23 on score lines 70 and 71, the latter coinciding with portions of line 15. The panels 68 and 69 are notched at the oppositely disposed outside corners and on the lateral edges to provide hook formations 72 and 73 which are adapted to engage beneath the edge of the bottom wall panel 22 at the recess 74. The portion of the blank 12 on the other side of the centerline a—a is cut and scored to provide corresponding panels and hinge scores and corresponding elements are identified by the same numerals primed.

Figure 1:
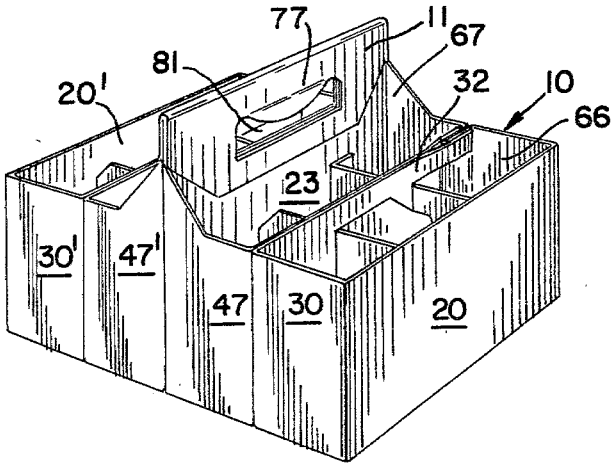
FIG. 1 is a perspective view of a bottle carrier carton in set-up condition which incorporates the principle features of the invention.
Figure 5:
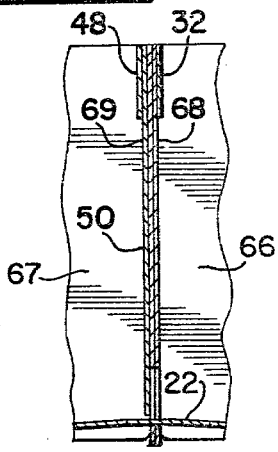
FIG. 5 is a fragmentary cross sectional view, to a larger scale, taken on the line 5—5 of FIG. 2.
Figure 2:
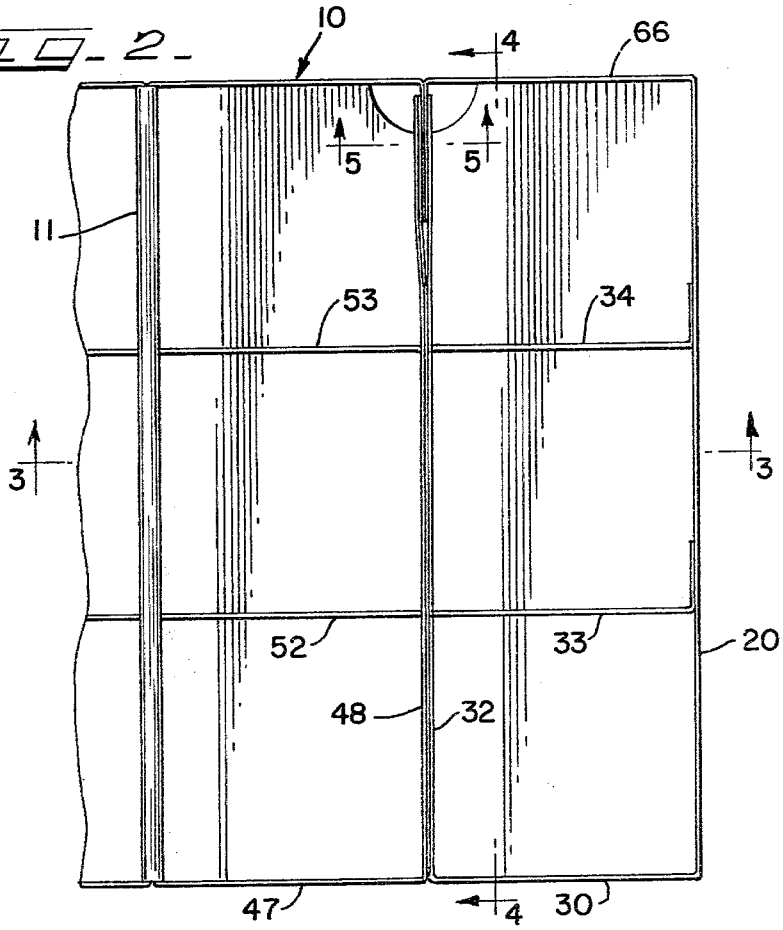
FIG. 2 is a partial plan view, to an enlarged scale, of the carton of FIG. 1.
Figure 3:
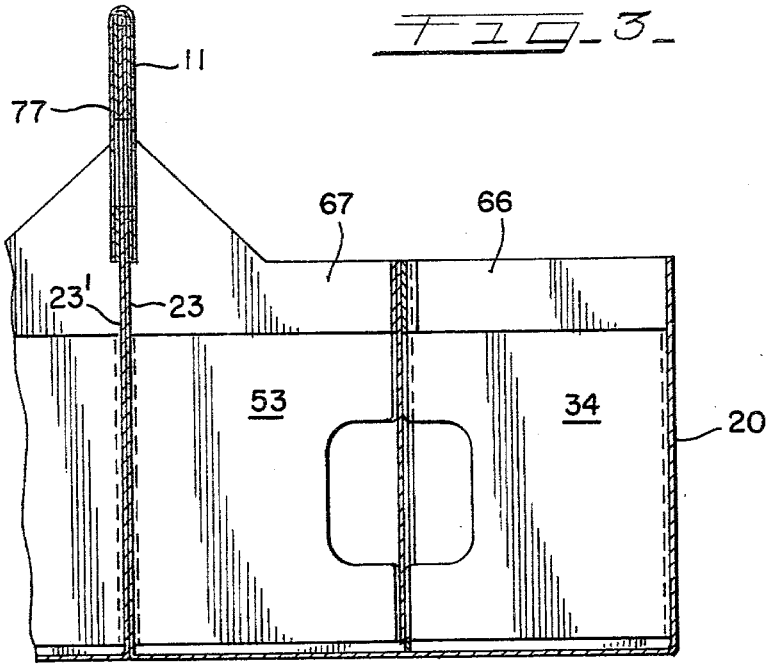
FIG. 3 is a cross sectional view taken on the line 3—3 of FIG. 2.
Figure 4:
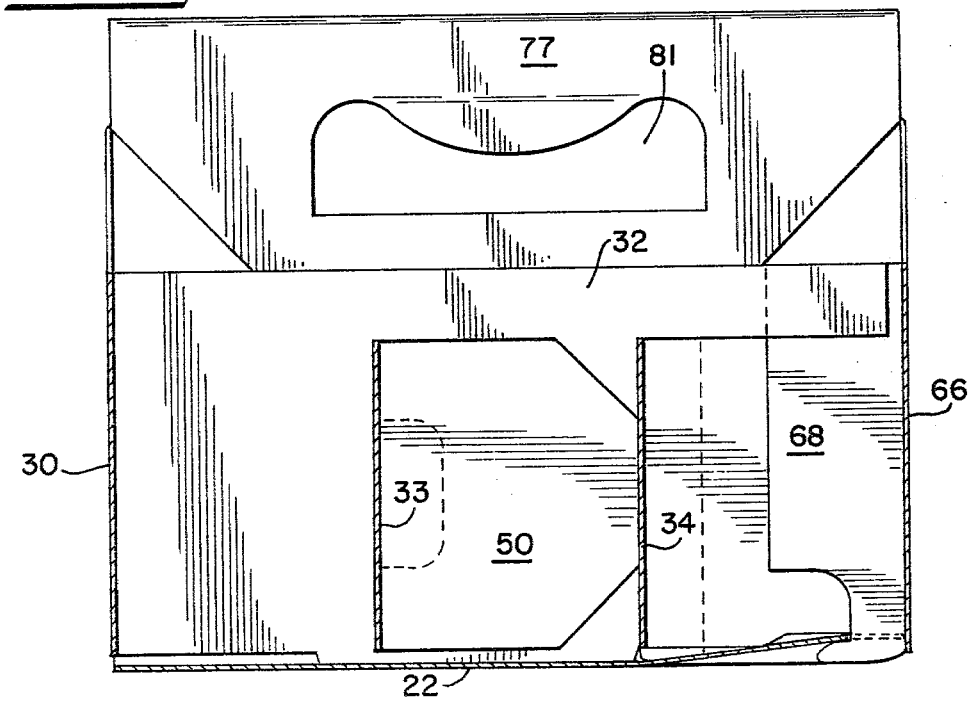
FIG. 4 is a cross sectional view taken on the line 4—4 of FIG. 2.

The two panels 23 and 28' have rectangular apertures 75 and 75' cut in portions adjacent the transverse center line a—a which are dimensioned and positioned to accommodate the fingers of the hand of the user in carrying the assembly. The finger holes or apertures 75, 75' are spaced a short distance from the line a—a and centered between the score lines 15 and 16. At the one side of the blank a handle reinforcing panel 76 is cut in the area of the material between the cutting lines 63 and 63' while at the opposite side of the blank a handle cover panel 77 is cut in the material in the area between the cutting lines 44 and 44'. The handle reinforcing panel 76 is provided with finger accommodating apertures 78, 78' and the handle cover panel 77 is likewise provided with finger accommodating apertures 80, 80' which are positioned so as to align in the final form of the carrier and form the hand hole 81 (FIGS. 1 and 4). The panels 76 and 77 are cut so as to hinge inwardly of the sides of the blank on score lines 82 and 83, respectively, which coincide with portions of the lines 15 and 16. The panels 76 and 77 and the adjoining handle portiions of panels 23 and 23' are scored or slotted on the line a—a to facilitate folding.

Figure 7:
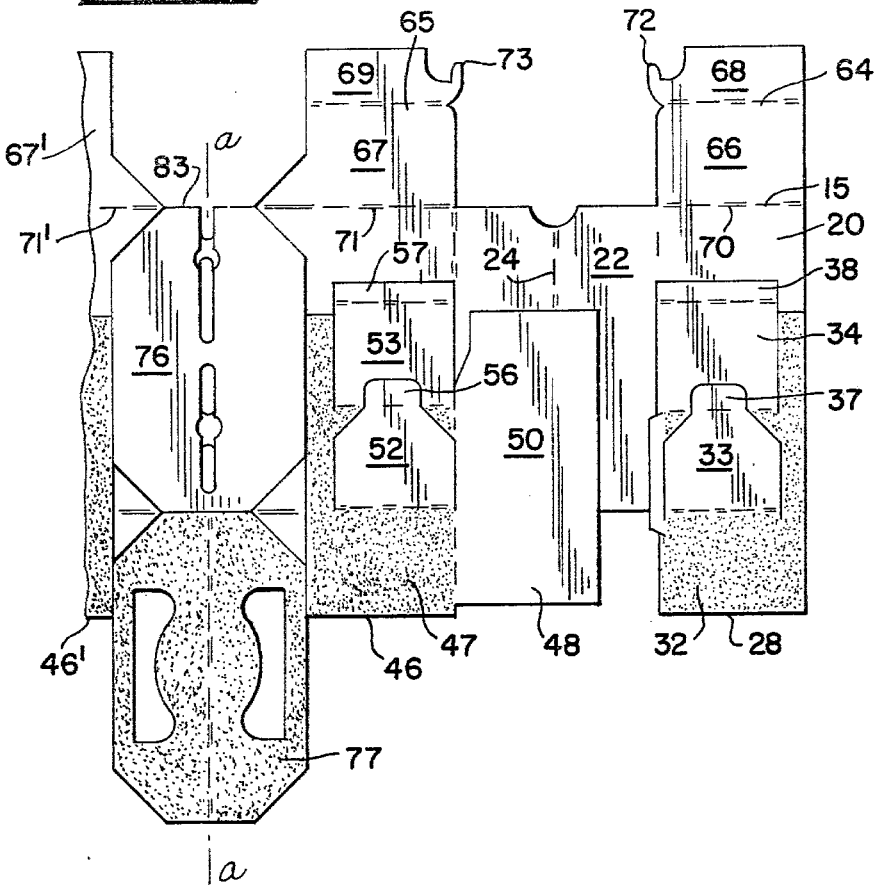
FIG. 7 is a plan view of a portion of the blank of FIG. 6 illustrating the first steps in the folding of the blank to form the carton of FIG. 1.
Figure 8:
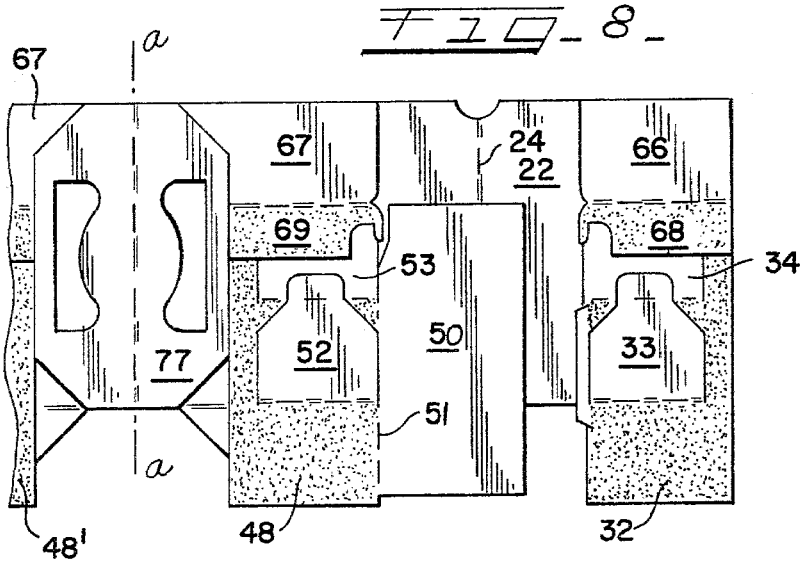
FIG. 8 is a plan view of the portion of the blank shown in FIG. 7 illustrating further folding operations.
Figure 9:
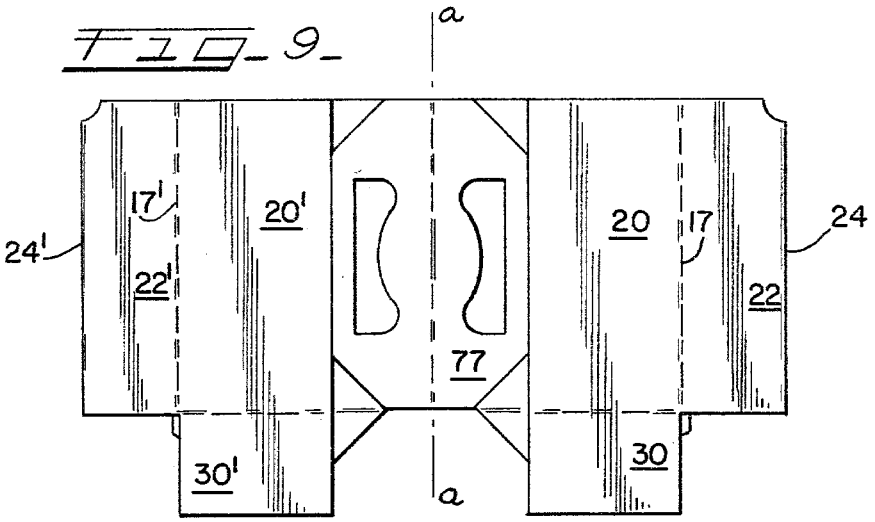
FIG. 9 is a plan view of the entire blank after a further folding operation, the outside face thereof being shown.
Figure 10:
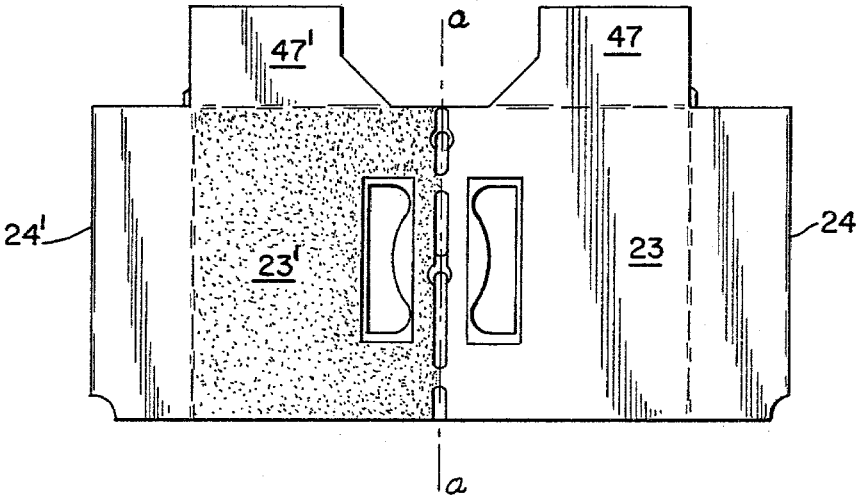
FIG. 10 is a plan view of the opposite or inside face of the blank in the condition shown in FIG. 9.
Figure 11:
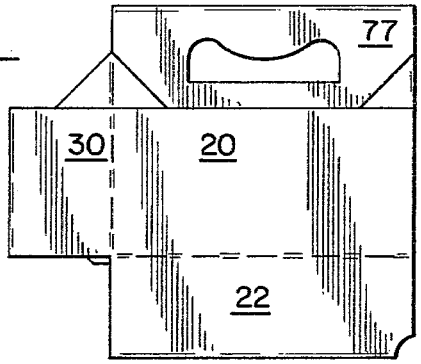
FIG. 11 is a plan view of the completed carton in collapsed condition, which may be erected into the form shown in FIG. 1.

The carton 10 is fabricated in collapsed condition with the panels in the blank being folded and secured together as illustrated in FIGS. 7 and 11. The panels at the one end of the blank, which are not illustrated in FIGS. 7 and 8, and which lie on the opposite side of the center line a—a, are glued and folded in the same manner as the panels on the side thereof which are illustrated in these two views. As shown in FIG. 7, the longitudinal and transverse partition forming panel sections at the one side of the blank are folded upon the hinge score lines 28, 46 and 28', 46' into overlying relation with the wall panels 20, 23 and 20', 23'. The glue tabs 37, 56 and 37', 56' on the cross partition panels 33, 52 and 33', 52' and the glue tabs 38, 57 and 38', 57' on the cross partition panels 34, 53 and 34', 53' have been pre-glued as shown on FIG. 6 and will adhere to the wall panels 20, 23 and 20', 23'. The handle reinforcing panel 76 which has been pre-glued as shown in FIG. 6 is folded on the hinge line 82 into overlying relation on the handle portions of the center partition and handle forming panels 23 and 33'. Glue may then be applied to the partition panels 32, 47 and 32', 47' after which the panels 66, 67 and 66', 67' may be folded on the hinge lines 70, 71 and 70', 71' into overlying relation with end portions of the partition panel structures and glue applied to the exposed face of the small panels 68, 69 and 68', 69'. The handle cover panel 77 which has been pre-glued is folded on the hinge line 83 into overlying relation with the previously folded handle reinforcing panel 76. This brings the panels into the position shown in FIG. 8. The folding on each side of the transverse center line is completed by folding the panels 50, 50' on the hinge lines 51, 51' and then folding the ends of the blank on the hinge lines 24, 24' which brings the panels into the position shown in FIG. 9. The fabrication of the carrier in collapsed condition is then completed by coating one of the panels 23 or 23' with an adhesive and folding on the transverse center line a—a. The completed carrier is shown in FIG. 11. The adhesive may be applied to the panels, where it is required, in a different sequence and in any convenient manner which will result in forming desired connections.

Figure 12:
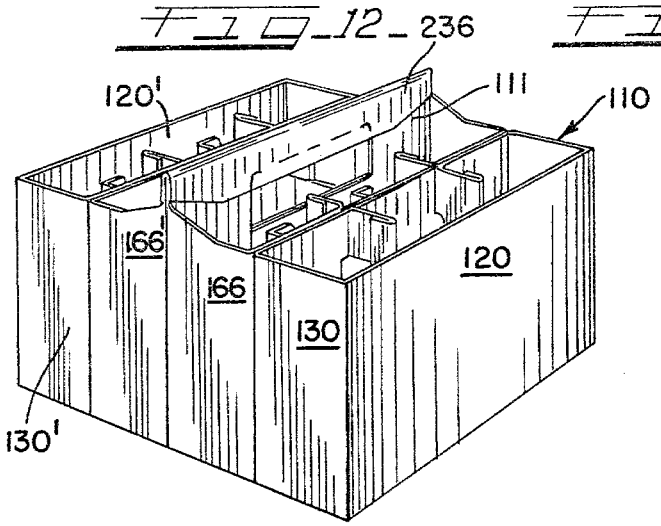
FIG. 12 is a perspective view of another form of the carton in erected condition.
Figure 16:
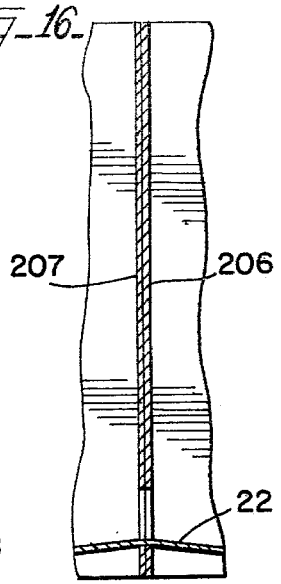
FIG. 16 is a fragmentary cross sectional view taken on the line 16—16 of FIG. 13, to a larger scale.
Figure 13:
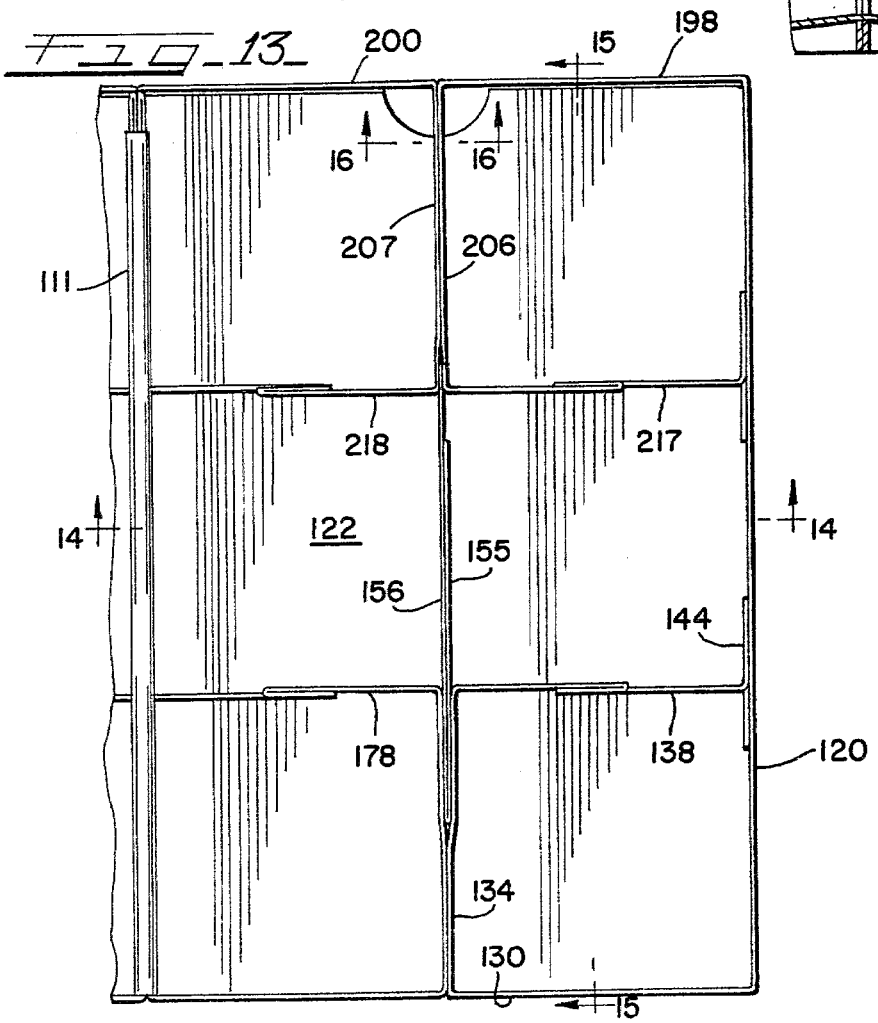
FIG. 13 is a plan view, to an enlarged scale, showing a portion of the carton of FIG. 12.
Figure 14:
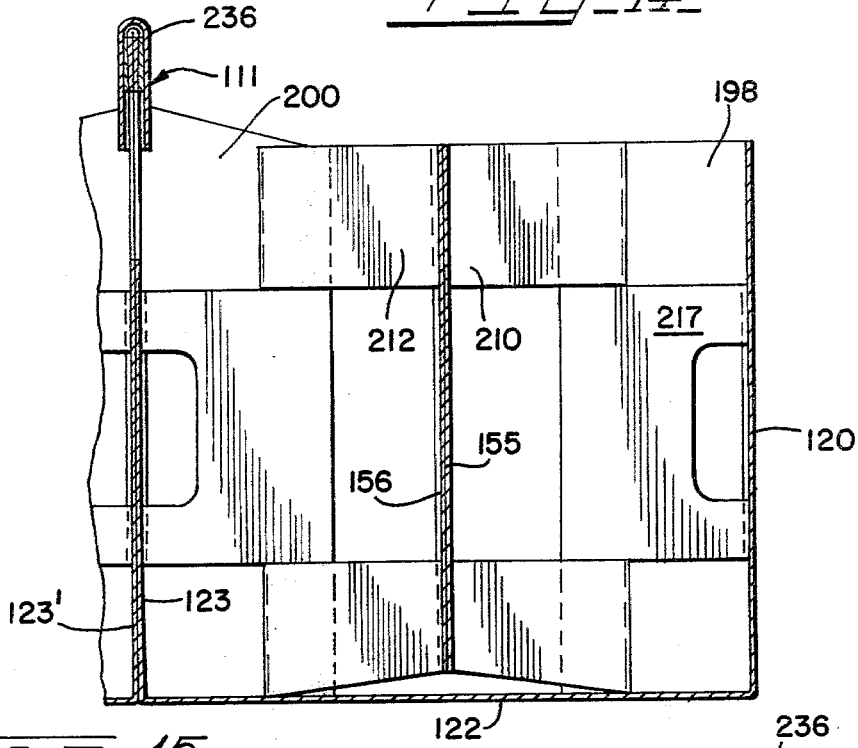
FIG. 14 is a cross sectional view taken on the line 14—14 of FIG. 13 and showing a portion of the carton of FIG. 12.
Figure 15:
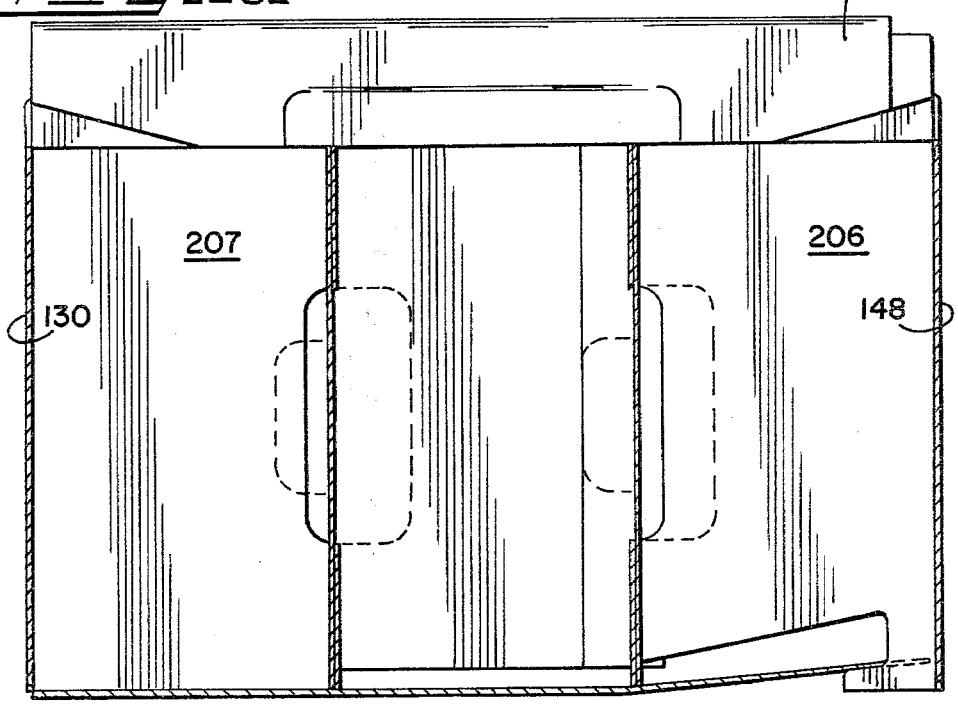
FIG. 15 is a cross sectional view taken on the line 15—15 of FIG. 13.
Figure 17:
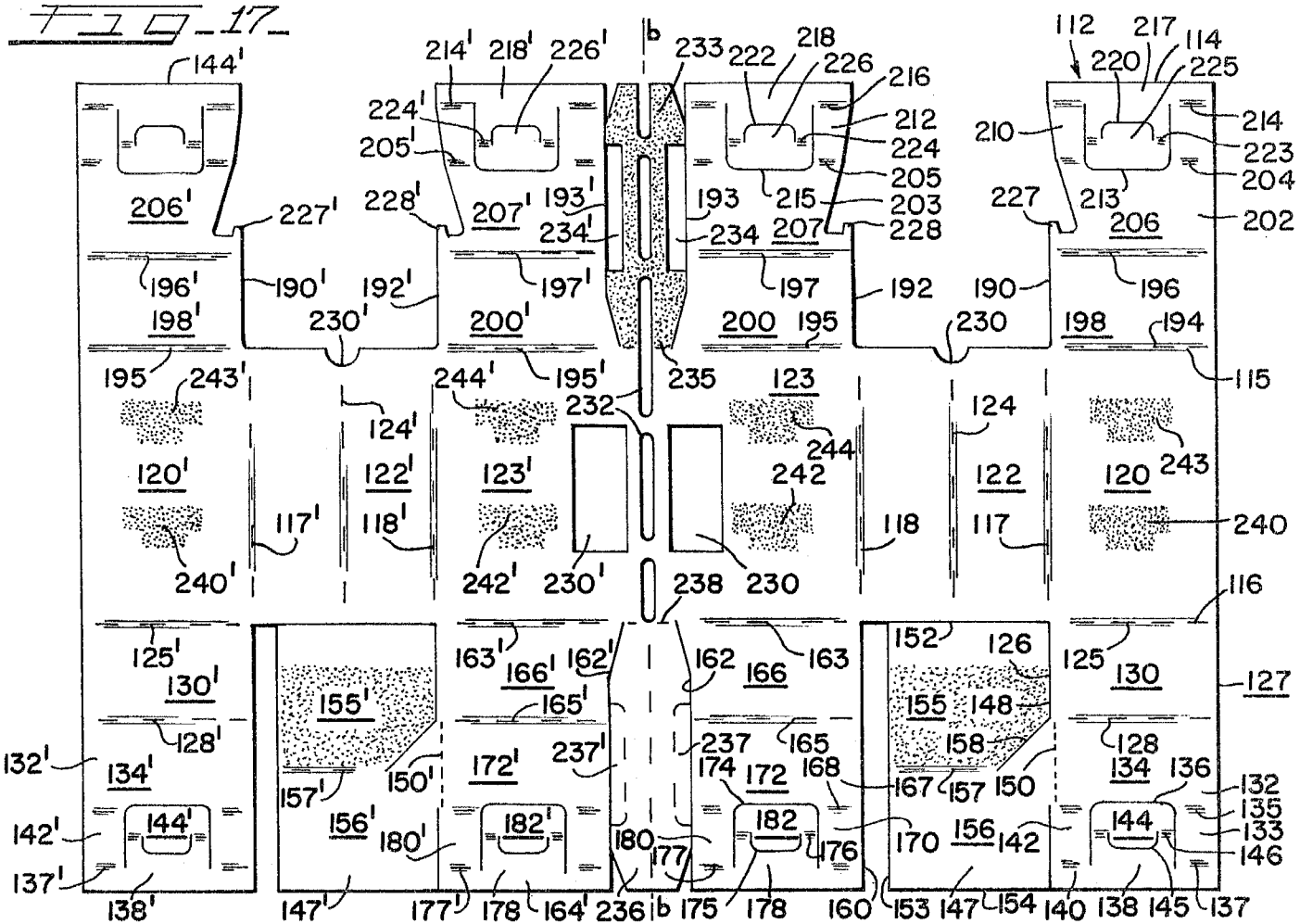
FIG. 17 is a plan view of a paperboard blank which is cut and scored preparatory to forming the carton of FIG. 12.
Figure 20:
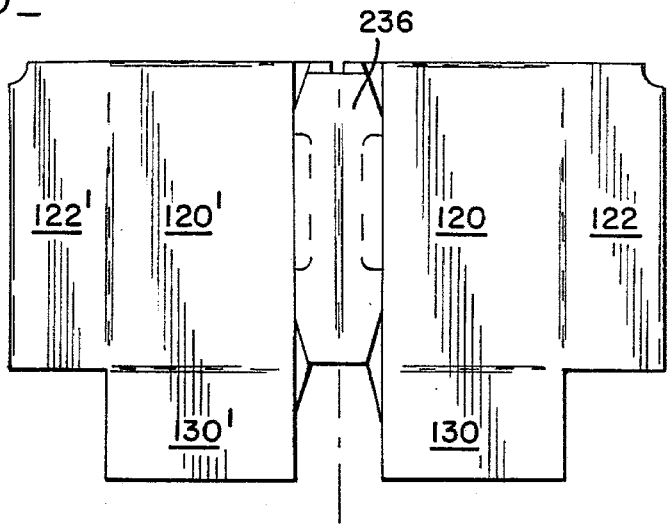
FIG. 20 is a plan view to a reduced scale, showing the outside face of the blank of FIG. 17 after still further folding steps.
Figure 21:
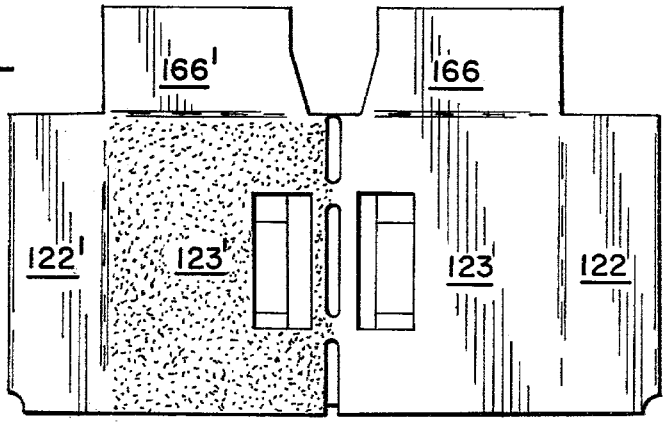
FIG. 21 is a plan view showing the opposite face of the blank in the partially folded condition shown in FIG. 22.

A form of the basket carrier is illustrated at 110 in FIG. 12, which is adapted to provide an assembly of pocket forming cells for receiving a double row of six bottles one each side of a center longitudinal partition and handle structure 111, with the bottles in each of the cells being separated from the bottles in the adjoining cells by a double thickness of the board material in the areas which require separation so as to comply with railway shipping requirements. The carton 110, which is shown in set-up, empty condition in FIG. 12, is adapted to be fabricated from a single blank 112 which is cut and scored as shown in FIG. 17.

The elongate, generally rectangular blank 112 is cut and scored so as to divide the same into wall and partition forming panels on opposite sides of a transverse center line b—b, which panels are thereafter folded and secured together to form the upwardly opening tray-like cellular basket assembly of FIG. 12. Since the blank is divided on the line b—b into two equal sections and the two sections are cut and scored to provide a like set of wall and partition panels, arranged substantially in mirror image relation on the opposite sides of the center line b—b, where an element on the one side of the line b—b has a counterpart on the opposite side of the same it will be identified by the same numeral primed.

The two blank sections 114 and 114' are divided by parallel, longitudinally extending, transversely spaced cutting and scoring lines 115 and 116, extending the full length of the blank, into center wall panel forming portions and partition panel forming portions extending along opposite side margins of the blank. The blank sections 114 and 114' are of equal dimension in the longitudinal direction of the blank 112, and have the center sections, which extend between the lines 115 and 116, subdivided by longitudinally spaced transverse score lines 117, 118 and 117', 118' to form side wall panels 120, 120', adjoining bottom wall forming panels 122, 122' and center partition and handle forming panels 123, 123', the latter lying along opposite sides of the line b—b. The bottom wall forming panels 122 and 122' are subdivided by transverse score lines 124, 124' into collapsible half panels. At the one side of the blank the material is cut so that an endwall and partition panel forming corner section of the blank extends laterally of the hinge score line 125 which coincides with the end portion of line 116. This section of the blank has a dimension longitudinally of the blank corresponding to approximately twice the dimension of the sidewall forming panel 120 in the same direction and is divided into two halves by a transverse cut and score line 126 which extends laterally at the end of transverse score line 117. The endmost half of this section, which extends between the line 126 and the end edge 127 of the blank, is subdivided by a score line 128 parallel with and spaced laterally of score line 125, to provide an end wall forming panel 130 and a partition forming panel 132. The end wall forming panel 130 has a dimension transversely of the blank 112 which corresponds to one half the distance between the score lines 117 and 118. The partition forming panel 132 is subdivided to provide a cross partition forming panel assembly 133 in the outboard margin and an intermediate panel portion 134 which is adapted to form part of the partition for separating the bottles in the two rows on that side of the central partition and handle structure 111. The panel 134 and the marginal panel portion 133 are separated on a hinge forming score line 135 which is parallel with and spaced outboard of the hinge score line 128, the spacing being determined by the size of the cells which will be determined, in turn, by the size of the bottles the carrier is designed to accommodate. The panel 133 which constitutes the corner of the blank is cut and scored to provide a cross partition arrangement between an endmost cell and a middle cell and which will include two double thickness of the blank material between the portions of the bottles which, without any separating partition, would contact each other. The panel 133 is cut on the outwardly opening U-shaped line 136, which is located with the legs of the U terminating at and interrupting a hinge-score line 137 so as to form a generally T shaped panel portion 138 which will hinge on the score line 137, with the relatively narrow endmost portion 140 adapted to overlie the remaining portions of the panel 133 adjacent the edges thereof which are defined by the hinge score line 137 and to span the space between the same which results from cutting on the U-shaped line 136 and the folding of the panel 238. The panel material defined between the legs of the U-shaped cut 136 has a glue tab formation 144 cut therein on the U-shaped line 145 which opens inwardly and extends to a hinge forming score line 146. A partition reinforcing panel 147 is cut in the blank material adjoining the panels 130 and 132 which is freed therefrom on the cutting lines 142 and 148 and remains hingedly connected on the hinge forming score line 150 which extends between the cutting line portions 142 and 148 of the line 126 and is offset therefrom slightly. The panel 147 corresponds in size to the panel 130, 132, the material being cut to free the same on the longitudinal line 152 and the transverse line 153. The line 152 coincides with a portion of the line 116 and the transverse line 153 is parallel with the score line 118 and is offset in the direction of the end edge 127 of the blank. The cutting line 153 extends latterly from the cutting line 152 to the side edge of the blank 154. The panel 147 is divided into two panel portions 155 and 156 by score line 157 which is parallel with the cutting line 152 and extends to a diagonal cutting line 158 which, in turn, extends to the intersection of score line 128 and transverse cutting line 148. This enables the panel portion 155 to be folded onto the panel portion 156 and the two portions to be folded about the hinge score line 150 into engagement with the panel 134 in forming the carrier. On the same side of the blank and of section 114 the material is cut on the longitudinally spaced transverse lines 160 and 162 to define between the same an end wall and partition panel forming section extending laterally of the a hinge score line 163 which coincides with a portion of the line 116. The cutting line 160 is an extension of transverse score line 118 and the distance between line 160 and line 126 corresponds to the distance between lines 117 and 118. The panel 147 is cut in this area of the blank. The blank section which is defined by cutting lines 160, 162, score line 163 and a portion of the side edge 154 of the blank, has the same dimension longitudinally and laterally of the blank, as the panel 130, 132 and the panel 155, 156. A score line 165, which is in alignment with the score line 128 divides this portion of the blank so as to form an end wall panel 166 and a partition panel assembly 167, with the latter being subdivided by the score line 168 into panels 170 and 172, which correspond to panels 133 and 134 in the panel 132. The panel 172 is adapted to form a part of the longitudinal partition along with the panel 134 for separating the bottles in the two rows while the panel 170, which is separated from the panel 172 on the score line 168, is cut on the U-shaped lines 174 and 175 and scored on the lines 176 and 177 to provide cross partition members 178, 180 and a glue tab 182 which correspond to members 138, 142 and 144 in the panel assembly 133. On this same side portion of the blank and on the opposite side of the transverse center line b—b the blank material is cut and scored to provide corresponding end wall and cell forming partition members for forming the cells or pockets for the two rows of bottles on that side of the central partition and handle forming structure including the panel 147' for reinforcing the partition between the bottles in the two rows. The panel 147', which is derived from the blank area corresponding to the area in section 144 which provides the panel 147 is freed from the end panel 132' and remains attached to the panel 164' so that the two panel portions 155' and 156' may be hinged upon each other on the score line 157' and then folded on the score line 150' into engagement with the partition panel 172'.

At the opposite side of the blank section 114 the material is cut on the transverse lines 190, 192 and 193 with lines 190 and 192 extending from the ends of score lines 117 and 118, to provide end wall partition forming panel portions which extend laterally of the blank from the longitudinal score lines 194 and 195, the latter coinciding with portions of the longitudinal line 115. These end wall and partition forming portions are subdivided by longitudinally aligned score lines 196, 197 to form a pair of end wall panels 198, 200 and a pair of partition forming panel portions 202 and 203. The score lines 196 and 197 are spaced from the score lines 194 and 195 a distance so that the end wall panels 198 and 200 correspond in size to the end wall panels 130 and 166 at the opposite side of the blank. The partition forming portions 202 and 203 are subdivided by score lines 204, 205 which are parallel with and spaced from score lines 196 and 197, into longitudinal partition panel members 206 and 207 and cross partition panel assemblies 210 and 212. The panels 210 and 212 are cut on the U-shaped lines 213 and 214 and scored on the lines 215 and 216 to form cross partition forming members 217 and 218 which are T-shaped and correspond to members 138 and 178 at the opposite side of the blank. Portions of panels 217 and 218 are cut on the lines 220 and 222 and scored on the lines 223 and 224 to provide glue tab formations 225 and 226, corresponding to glue tab formations 144 and 182 at the opposite side of the blank. The oppositely disposed transverse edges of the panels 206 and 207 are slotted as shown to provide hook formations 227 and 228 which are adapted to engage in supporting relation beneath the bottom wall panel 122 at the end edge recess 230. The corresponding material at the other end of the blank is cut and scored in like manner so as to form in the blank section 144' a duplicate set of panels in mirror image arrangement and elements therein which correspond to elements in section 144 of the blank are identified by the same numerals primed. The two panels 123 and 123' have rectangular finger accommodating apertures 230 and 230' cut therein on opposite sides of the transverse center line b—b which are adapted to align with each other when the panels are folded on the line b—b. To facilitate folding a series of aligned narrow slots 232 are cut on the line b—b which is otherwise scored for folding. A handle reinforcing panel 233 is formed in the relatively narrow area between the parallel transverse cutting lines 193 and 193'. The panel 133 is slotted along its edges at 234 and 234' for aligning with the finger or hand hole apertures 230 and 230' when the panel 233 is folded on the hinge score line 235 which hinge line 235 coincides with a portion of line 115. The slots 232 are extended into the panel 233 to facilitate the folding. At the opposite side of the blank a handle cover panel 236 is formed in the material between the spaced transverse cutting lines 162 and 162' which correspond in size and shape to the panel 233 but is not apertured. Small, narrow hand hole reinforcing tabs 237 and 237' are formed in opposite transverse edges which align with and may be folded into the apertures 230, 230' when the panel 236 is folded on the hinge score line 238 which score 238 coincides with a portion of line 116.

Figure 22:
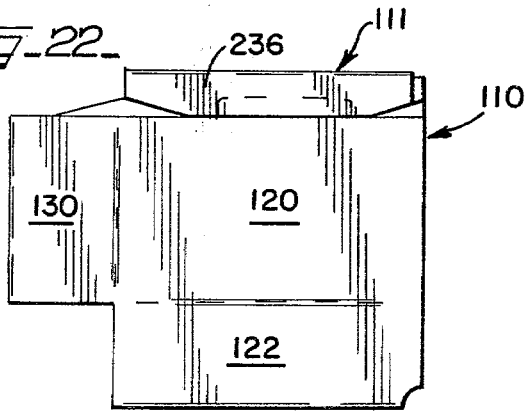
FIG. 22 is a plan view of the completed carton in fully collapsed condition.

The carton 110 is fabricated in collapsed condition as illustrated in FIGS. 18 to 22. The glue tabs 144, 182, 144' and 182' are initially spotted with adhesive on the face opposite the face which is exposed in FIG. 17, or the wall and partition panels 120, 120' and 123, 123' may be spotted with the adhesive as indicated at 240, 242, 243, 244 and 240', 242', 243', 244' in FIG. 17 where the glue tabs will engage when they are folded. An adhesive is applied to the exposed face, in FIG. 17, of either the panels 155, 155' or the panels 156, 156' and each pair of these panels is folded on the associated hinge line 157, 157' into face engagement. The panels 138, 178 and 138', 178' are folded about score lines 137, 177 and 137', 177' though 180 degrees to bring the opposite face in FIG. 17 uppermost and the partition forming assembly of panels is folded into the position shown in FIG. 18 where the glue tabs 144, 144', 182, 182', will be adhesively secured to the wall and partition panels 120, 120' and 123, 123'. On the opposite side of the blank the panels 217, 218 and 217', 218' are folded 180 degrees about the hinge-score lines 214, 216 and 214', 216' after which the partition panel assemblies 202, 203 and 202', 203' are folded about the hinge score lines 204, 205 and 204', 205' into the position shown in FIG. 18. The handle reinforcing panel 233, with adhesive on the face exposed in FIG. 17, is folded upon score line 235. This brings the panels into the condition shown in FIG. 18. Adhesive is applied to handle cover panel 236 which is then folded about hinge score line 238 to the position shown in FIG. 19. Adhesive is applied to panels 134 and 134' in a pattern as shown. If adhesive has not been previously applied at 243, 244 and 243', 244' to panels 120, 128 and 120', 128', it is applied in the pattern shown, or adhesive is applied to exposed faces of tabs 225, 226 and 225', 226'. The end wall and partition panel assemblies 198, 202 and 200, 203 together with assemblies 198', 202' and 200', 203' are folded on the hinge lines 194, 195 and 194', 195' into the position shown in FIG. 19. The associated folded panels 155, 156 and 155', 156' are then folded about the hinge score lines 150, 150' into the position illustrated in FIG. 19. Adhesive is applied to panels 206 and 172 and the partition and wall panel assemblies at opposite ends of the blank are folded on the hinge score lines 124, 124', into the position shown in FIGS. 20 and 21. The one center partition panel 123 or 123' is coated with an adhesive and the carrier is completed, by folding the two halves on the line b—b, in collapsed condition as shown in FIG. 22. In this form of the carrier the adhesive, where required, may be applied in a different sequence and in any convenient manner.

The embodiments of the invention in which an exclusive property or privilege is claimed are defined as follows:

1. An upwardly opening tray-like carrier carton for packaging a plurality of articles having the general form of beverage bottles said carton being formed from a single elongate blank of foldable sheet material which is cut and scored so as to divide it into a series of integrally connected panels which may be folded and secured together to form the carton, said carton comprising a double row of upwardly opening article receiving cells disposed on opposite sides of a central article separating partition and handle forming structure, which central partition and handle structure comprises a pair of full depth panels disposed in back to back relation which are hingedly connected to each other at the top edges thereof and hingedly connected at opposite ends to a reinforcing handle panel and a handle cover panel, said handle reinforcing and cover panels being folded down along said top edge and secured to the opposite outer faces of the handle forming top portions of said pair of full depth panels, said central partition and handle structure being hingedly connected at its opposite ends to vertical edges of a pair of hingedly connected foldable end wall forming panels each of which constitutes the inboard one of a pair of end wall forming panels at the end of each double row of article receiving cells, the outermost vertical edge of the outboard one of said end wall forming panels at the ends of said cells being hinged to the end edge of a vertical sidewall forming panel, each said sidewall panel being hingedly connected to the outboard edge of a foldable bottom wall panel which has its opposite edge hingedly connected to the bottom edge of said central partition and handle structure and the cells in each of said double row of cells being defined in part by an upstanding partition wall which extends between the rows and which is hinged at its opposite ends to adjoining vertical edges of said pairs of end wall forming panels at the ends of said cells so as to enable the cells on each side of said central partition and separating wall structure to be collapsed when empty and to be folded into flattened relation against said central separating partition and handle forming structure.

2. An upwardly opening collapsible carrier for a plurality of articles having the general form of beverage bottles which carrier is fabricated from a single elongate blank of foldable sheet material which is cut and scored so as to divide it into a series of integrally connected panels adapted to be folded and secured together so as to form a double row of upwardly opening article receiving cells disposed on opposite sides of a central article separating partition and handle forming structure, said central partition and handle forming structure comprising a pair of upstanding panels secured in face to face relation which are connected to each other at the top edges on an integral fold line and which are integrally connected in hinged relation at opposite ends to a handle reinforcing panel and a handle cover panel said handle reinforcing and cover panels being folded down along said top edges and secured to opposite outer faces of the handle forming top portions of said pair of upstanding panels, said central position and handle structure being hingedly connected at its opposite ends to vertical edges of a pair of hingedly connected foldable end wall forming panels each of which constitutes the inboard one of a pair thereof at the end of each double row of article receiving cells, the outermost vertical edge of the outboard one of said end wall panels being hingedly connected to the end edge of a vertical sidewall forming panel, and each sidewall forming panel being integrally connected in hinged relation at its bottom edge to the outboard edge of a pair of collapsible bottom wall forming panels which have their opposite edges integrally connected in hinged relation to the bottom edges of said full depth panels of said partition and handle structure, the cells in each of said double row of cells being defined in part by an upstanding partition wall which extends between the rows and which has opposite end portions hinged to adjoining vertical edges of said pairs of end wall panels so as to enable the double row of cells on each side of said central partition and separating wall structure to be folded, when empty, into flattened relation against said central separating partition and handle forming structure.

3. An upwardly opening collapsible article carrier as set forth in claim 2 wherein said upstanding partition wall which extends between the article rows comprises a pair of partition panels at each end thereof which are hingedly connected at the outermost edges to a pair of said end wall panels and which have at the innermost edges integrally hinged cross partition structures which cross partition structures are folded in part upon themselves and hingedly connected to the oppositely disposed vertical faces of the associated sidewall panel and the central partition and handle structure, so as to provide a double thickness of blank material for separating the articles in adjoining cells.

4. An upwardly opening collapsible article carrier as set forth in claim 2 wherein said upstanding partition wall which extends between the article rows comprises a pair of partition panels at each end thereof which are hinged to the end walls and which have their innermost margins connected by a pair of reinforcing panels, said reinforcing panels being folded upon each other and hinged upwardly of the bottom edge of one of said upstanding partition wall panels and said reinforcing panels being of a size to bridge the gap between the end pairs of partition wall panels with a double thickness of material for separating the articles in the pair of cells which are disposed between the cells adjoining the end walls.

5. An upwardly opening collapsible article carrier as set forth in claim 2 wherein said upstanding partition wall which extends between the article rows comprises a pair of partition panels at each end thereof which are hingedly connected at the outermost edges to a pair of end wall panels, one of said pair of partition panels extending substantially the full length of said upstanding partition wall and having cut therefrom integrally hinged cross partition panels which cross partition panels extend to a hinged connection with the oppositely disposed vertical faces of the associated sidewall panel and the central separating partion and handle structure, said cross partition panels being spaced so as to provide for separating the articles in adjoining cells.

6. An upwardly opening collapsible article carrier as set forth in claim 2 wherein said upstanding partition wall which extends between the cells in the double rows thereof comprises a pair of partition panels at each end thereof, each of said pair of partition panels having cut in the inner ends thereof hinged cross partition panel structures which extend to a hinged connection with the associated sidewall and the central separating partition and handle structure, and a partition panel connecting the innermost ends of said pairs of said partition panels which partition panel is cut and scored so as to be divided into two hingedly connected portions which are folded in part so as to provide a double thickness of panel material in an article separating area centrally of said partition wall.

7. A cut and scored blank of foldable sheet material for fabricating a multi-cellular basket style carrier for articles having the general form of beverage bottles which are supported in a double row of cells arranged on opposite sides of a central partition and handle structure, said blank comprising a generally rectangular sheet of the material which is divided by a pair of parallel, transversely spaced, longitudinally extending, partly scored, partly cut lines, into a longitudinally extending central wall panel forming section and side marginal partition forming panel sections, said central section being divided by a series of parallel, longitudinally spaced transversely extending score lines into sidewall forming panels at opposite ends of the blank, bottom wall forming panels adjoining the sidewall panels and center partition and handle forming wall panels which are disposed on opposite sides of the central one of the transverse score lines which constitutes a transverse center line and divides the blank into two equal sections, the side marginal section at one side margin of the blank being cut and scored to provide end wall and partition forming panels extending from the sidewall and the partition and handle forming panels, respectively, on opposite sides of said transverse center line, and a handle forming panel interposed between the panels which extend from the adjoining center partition and handle forming panels and the side marginal section at the other side of the blank being cut and scored to provide end wall and partition forming panels extending from the sidewall and the partition and handle forming panels, respectively, on opposite sides of the transverse center line, and a handle forming panel interposed between the end wall and partition forming panels which extend from the partition and handle forming panels on said other side of the blank, said partition forming panels on said one side of the blank which extend from the partition and handle forming panels having cut therein cross partition panel members which are positioned to hinge about transversely spaced score lines which extend longitudinally of the blank.

8. A cut and scored blank as set forth in claim 7 wherein the side marginal section at said one side margin of said blank is cut and scored to provide a generally rectangular panel which is separated by a hinge forming score line from one of said partition forming panels and which is dimensioned so as to bridge, in the fabricated carrier the space resulting from cutting the cross partition panels from said partition forming panels.

9. A cut and scored blank as set forth in claim 7 wherein the side marginal section at said one side of the blank is cut and scored to provide a generally rectangular partition connecting and reinforcing panel which is separated from the adjoining partition forming panels by a hinge score line so as to enable it to be folded into face engagement with said partition forming panel in fabricating the carrier.

10. A cut and scored blank as set forth in claim 9 wherein said partition connecting and reinforcing panel is divided by a hinge score line which extends longitudinally of the blank and is spaced outwardly of the associated score line dividing the end wall forming panel and the partition panel and which enables said panel to be folded into double ply relationship.

* * * * *

UNITED STATES PATENT AND TRADEMARK OFFICE

CERTIFICATE OF CORRECTION

PATENT NO. : 4,253,564

DATED : March 3, 1981

INVENTOR(S) : Engdahl, Jr.

It is certified that error appears in the above—identified patent and that said Letters Patent is hereby corrected as shown below:

Column 2, line 46, delete "row" and insert in place thereof -- rows --.

Column 6, line 3, delete "portiions" and insert in place thereof -- portions --.

Column 7, line 66, delete "238" and insert in place thereof -- 138 --.

Column 9, line 54, delete "correspond" and insert in place thereof -- corresponds --.

Column 12, line 31, delete "partion" and insert in place thereof -- partition --.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*